US009394105B2

(12) United States Patent
Li

(10) Patent No.: US 9,394,105 B2
(45) Date of Patent: Jul. 19, 2016

(54) OIL STORAGE AND TRANSPORTATION APPARATUS

(75) Inventor: Shuwei Li, Chengdu (CN)

(73) Assignee: SHENZHEN TANER ENVIRONMENTAL STORAGE AND TRANSPORT TECHNOLOGY CO., LTD., Shenzhen (CN)

( * ) Notice: Subject to any disclaimer, the term of this patent is extended or adjusted under 35 U.S.C. 154(b) by 1558 days.

(21) Appl. No.: 13/059,062

(22) PCT Filed: Jul. 31, 2009

(86) PCT No.: PCT/CN2009/073036
§ 371 (c)(1),
(2), (4) Date: Feb. 14, 2011

(87) PCT Pub. No.: WO2010/017744

PCT Pub. Date: Feb. 18, 2010

(65) Prior Publication Data

US 2011/0139788 A1 Jun. 16, 2011

(30) Foreign Application Priority Data

Aug. 15, 2008 (CN) ..... 2008 1 0045826

(51) Int. Cl.
*B65D 90/04* (2006.01)
*B65D 90/28* (2006.01)

(52) U.S. Cl.
CPC ..... *B65D 90/046* (2013.01); *B65D 90/28* (2013.01); *B65D 2590/046* (2013.01)

(58) Field of Classification Search
CPC .. B65D 77/065; B65D 88/08; B65D 88/1606; B65D 88/22; B65D 90/00; B65D 90/026; B65D 90/046; B65D 90/28; B65D 90/30; B65D 90/38; B65D 2590/046; B60K 15/01; B60K 15/03; B60K 15/03504; B60K 15/04–15/05; B60K 15/061; B60K 2015/03046; B60K 2015/03065; B60K 2015/03217; B60K 2015/03236; B60K 2015/03447; B60K 2015/03467; Y10T 137/86324
USPC ..... 220/495.01, 495.05–495.06, 495.11, 220/530, 562, 567.2–567.3, 601, 666, 220/720–721, 723, 86.2, 88.1, 88.3, 220/FOR. 116; 137/14, 312–313, 392, 587; 73/290 R, 291; 264/242, 255, 269
See application file for complete search history.

(56) References Cited

U.S. PATENT DOCUMENTS 3,167,209 A * 1/1965 Jones ..... B65D 90/046 220/495.04
3,409,714 A * 11/1968 Strugar, Jr. ..... B60K 15/03 222/105
3,477,611 A * 11/1969 Niles ..... B60K 15/03 220/202
3,949,720 A * 4/1976 Zipprich ..... B60K 15/03504 123/518
3,968,896 A * 7/1976 Giacoletti ..... B60K 15/03 220/723
4,117,947 A * 10/1978 Androulakis ..... F17C 3/04 156/71
4,254,887 A * 3/1981 Bold ..... B65D 90/38 220/216
5,067,636 A * 11/1991 Pfeiffer ..... B65D 77/06 222/105
5,163,485 A * 11/1992 Hermann ..... B65D 88/62 141/10

(Continued)

*Primary Examiner* — J. Gregory Pickett
*Assistant Examiner* — Brijesh V. Patel

(57) ABSTRACT

The present invention is an apparatus with flexible membrane for oil storage and transportation, comprising outer wall, installation opening, blocking cover, oil inlet, oil outlet and breathing orifice. The membrane is arranged in outer wall and fixed in the installation opening or the fixing part of outer wall. The rest of membrane is separated from outer wall. Valve and quick coupling are arranged in both oil inlet and oil outlet.

10 Claims, 8 Drawing Sheets

(56) References Cited

U.S. PATENT DOCUMENTS 5,315,872 A * 5/1994 Moser ..... G01F 23/268 361/284
5,547,331 A * 8/1996 Podd ..... B60P 1/60 141/10
5,558,245 A * 9/1996 White ..... B65D 90/046 137/343
5,913,451 A * 6/1999 Madison ..... B60K 15/01 220/723
6,260,544 B1 * 7/2001 Spry ..... B60K 15/03504 123/516
6,286,700 B1 * 9/2001 Davidson ..... B65D 77/065 220/1.6
6,988,639 B2 * 1/2006 Arch ..... F16L 41/08 222/105
7,172,825 B2 * 2/2007 Adams ..... F16K 24/04 215/3
7,389,688 B1 * 6/2008 Vander Horst ..... G01F 23/02 210/86
2004/0200842 A1 * 10/2004 Low ..... B65D 90/046 220/495.01
2004/0211782 A1 * 10/2004 Howe ..... B65D 77/065 220/495.06

* cited by examiner

OIL STORAGE AND TRANSPORTATION APPARATUS

FIELD OF THE INVENTION

The present invention relates to an apparatus for storage and transportation of oil under low and ordinary pressure, and more particularly to oil storage and transportation technology.

BACKGROUND ART

Currently, the transportation, storage and use of oil involve procedures including pipeline delivery, transportation of railway oil tank car and automobile oil tank car, tanker transportation, oil depot storage, gas station storage, etc. Since the floating-roof technology is adopted in the oil depot storage, over 90% breathing loss of oil is reduced. However, large and small tank breathing still happens in other procedures, resulting in evaporation loss and quality degradation of oil as well as environmental pollution. Also, large and small tank breathing may even lead to a high risk of fire and explosion.

The breathing loss shall in the following be further described with gasoline as an example.

According to *Gasoline and Oil Gas Emission Control Standard for Oil Product Sales Industry* by the Safety and Environmental Protection Bureau of China Sinopec Group Corporation, gasoline suffers around 1% loss during such procedures as railway oil tank and automobile oil tank transportation, oil tanker storage, gas station storage; annual consumption of gasoline in China is over 50 million tons, with a loss of more than 500,000 tons. As oil price exceeds 7000 yuan/ton at present, the cost amounts to more than 3.5 billion yuan, excluding the loss of apparatus (automobile) oil tank.

Also, oil vapor pollutes environment. With most gas stations situated around urban areas, each certain unit of oil vapor is able to pollute air of 2000 times the volume of said oil vapor. Generally, during the process of transportation and sales, 50 million tons of gasoline will produce oil vapor of at least 5 times the volume of the gasoline, amounting to 340 million cubic meters. This means that 680 billion cubic meters of air will be polluted. Since oil vapor reacts with toxic gas in the air under the radiation of ultraviolet ray, more toxic pollutants will be produced and do more harm to human body as well as destroy the ozone layer (the oil vapor recycling reform in Beijing has been completed before the 2008 Olympic Games). Moreover, oil vapor increases the possibility of fire and explosion which is more destructive to ecological environment.

Through large and small tank breathing, the water vapor in the air enters the storage tank and becomes liquid water when interior temperature decreases, which then adversely affects the quality of oil products.

Besides gasoline, there are many other highly volatile products such as solvent oil, naphtha, aviation kerosene, light diesel oil, crude oil, etc. The evaporation of these oil products result in greater loss and more severe environmental pollution.

Although some tank cars, gas stations and storage depots may recycle the oil vapor through adsorption, condensation and absorption or membrane separation, the recycling needs large investment, consumes energy resources and is not efficient. A set of recycling equipment for a storage depot is as expensive as 5~15 million yuan and one for a gas station 0.3~1 million yuan. According to the operation of installed equipment in Taiwan and the Mainland China, the recycling equipment has a high failure rate and a high maintenance fee; most of the recycled oil vapor is of no use but to be burnt. Moreover, oil vapor, mixed with air, can be of greater danger during transportation. Therefore, the fundamental and most efficient way to solve the problem is to deal with at the very beginning of the generation of oil vapor.

SUMMARY OF THE INVENTION

In order to reduce the breathing loss during the transportation of oil products by storage depot tank, railway and road tank, gas station tank, equipment oil tank and other devices as well as solve the entailed problems related to environment, safety and quality, the present invention provides an apparatus with membrane for storage and transportation of oil.

The general structure of the present invention comprises outer wall 1, installation opening 3, sealing cover plate 5, oil inlet 6, oil outlet 7, access opening 13 and breathing orifice 10. A membrane 2 is arranged inside outer wall 1 and fixed thereto at the installation opening 3, oil inlet 6 or oil outlet 7. The rest part of membrane 2 is separated from outer wall 1. Oil inlet 6 and oil outlet 7 are arranged on the top or bottom of the tank, and both are provided with valve 15 and quick coupling 22. A chamber 12 formed by membrane 2 seals and stores oil, while most part of membrane 2 expands or shrinks as a function of large and small tank breathing.

In microscopic view, evaporation is the departure of liquid molecules from the liquid surface. When liquid molecules collide with each others during irregular movement, greater kinetic energy is obtained by some molecules. Given the kinetic energy of such molecules is larger than that needed to overcome the gravitation between liquid molecules to fly out of the liquid, these molecules will become vapor.

Covering the liquid surface with a flexible membrane can block the liquid molecules from escaping, thus preventing the oil from contacting the air. Then oil breathing takes place outside the membrane and oil vapor will not be mixed with the air. By doing so, the storage and transportation of oil can be energy-saving, environmental-friendly and safe without risks of fire or explosion. Also, the membrane helps to maintain the quality of oil as it prevents oxidation and mixture with water. The flexible structure of the membrane will facilitate the oil's resistance to external forces like crash.

By applying the present invention to transportation tank car, gas station oil tank and automobile tank, a closed storage and transportation (use) of oil can be achieved. By preventing direct breathing of oil and air, this way of storage and transportation eliminates oil vapor pollution and enhances safety.

There are three elements contributing to the breakout of fire disaster in an oil depot, that is oil vapor, air and kindling material. When the said membrane is covered completely over the oil surface, the air is blocked from the oil. Therefore, the risk of fire danger is largely reduced and safety of tank car, oil tank and fuel tank greatly improved.

When a flexible membrane is used to cover the oil surface during transportation and storage, breathing takes place outside the said membrane and the oil vapor is thus prevented from contacting air. Among others, the benefits of this invention are exemplified as follows:

Direct breathing of oil vapor and air is prevented, thus protecting the environment.

The transportation and storage conditions of oil in gas stations are improved so as to protect the personal health of attendant.

Energy is saved as breathing loss is prevented.

Safety is heightened by separating oil vapor from air.

The quality of oil is maintained as the loss of volatile fraction is avoided.

Oxidation is prevented from adversely affecting the oil quality, as oil is separated from air.

The condensed water and rainwater in the air are prevented from contacting the oil to maintain oil quality.

A membrane with strong anti-sticking capability may be used to reduce attachment of sediments for convenience to clean.

A membrane with good corrosion resistance may be used to reduce repairing work and minimize chances of repairing.

When several membranes are used, the tank can store several kinds of oil, with the volume of each kind of oil adjustable and transportation efficiency improved.

The flexible membrane can improve the resistance to impact and prevent leakage in case of damage to tank body.

The investment in modifying oil vapor recycling and bottom oil storage is reduced.

The present invention can be well applied to ordinary storage tank, tank car and device oil tank. It prevents most of current oil vapor pollution and prevents sinking of floating roof.

LIST OF REFERENCES

1—Outer Wall; 2—Membrane; 3—Installation Opening; 4—Fixed Part of Membrane; 5—Sealing Cover Plate; 6—Oil Inlet; 7—Oil Outlet; 8—Output Oil Pump; 9—Output Oil Pump Cover; 10—Breathing orifice; 11—Safety Valve; 12—Oil Storage Chamber; 13—Access Opening; 14—Leakage Detection Sensor; 15—Valve; 16—Insulation Layer; 17—Floater; 18—Discharge Hose; 19—Discharge Pipe; 20—Oil Tank Filling Pipe; 21—One-way Valve; 22—Quick Coupling; 23—Top Access Cover Plate of Oil Tank; 24—Oil unloading port of Oil Tank; 25—Quick coupling of Oil Gun; 26—Oil Gun; 27—Oil Gun Air Port; 28—Separate Space; 29—Sewage drain pipe; 30—Rainwater Pipe; 31—Rainwater Exit; 32—Bolt; 33—Conductive Gasket; 34—Liquid Level Sensor; 35—Flange; 36—Conductive Adhesive; 37—Inner Layer of Composite Membrane; 38—Middle Layer of Composite Membrane; 39—Outer Layer of Composite Membrane; 40—Access Valve.

DETAILED DESCRIPTION OF PREFERRED EMBODIMENTS

The present invention will be further described in the following embodiments with reference to the drawings.

Embodiment I

Figure 9:
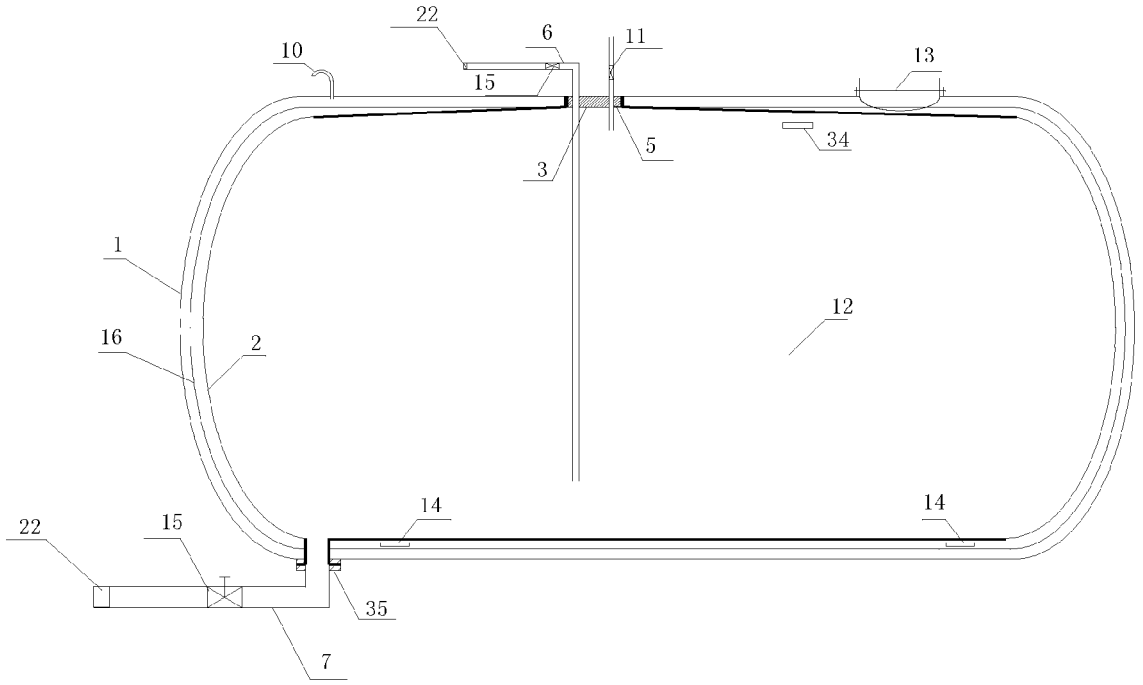
FIG. 9 shows the structure of Embodiment 1 (Tank Car 1)

Tank Car 1 (membrane fixed on the bottom and top): as shown in FIG. 9, comprising outer wall 1, installation opening 3, sealing cover plate 5, oil inlet 6, oil outlet 7, access opening 13 and breathing orifice 10. Oil inlet 6 is arranged on the top of the tank and oil outlet 7 in the bottom of the tank. Membrane 2 is arranged inside outer wall 1, while insulation layer 16 is arranged between outer wall 1 and membrane 2. Insulation layer 16 clings to outer wall 1, and membrane 2 is fixed on installation opening 3 and flange 35 of bottom oil outlet 7. The rest part of membrane 2 is separated from insulation layer 16. Valve 15 and quick coupling 22 of tank car are arranged in both oil inlet 6 and oil outlet 7.

Figure 3:
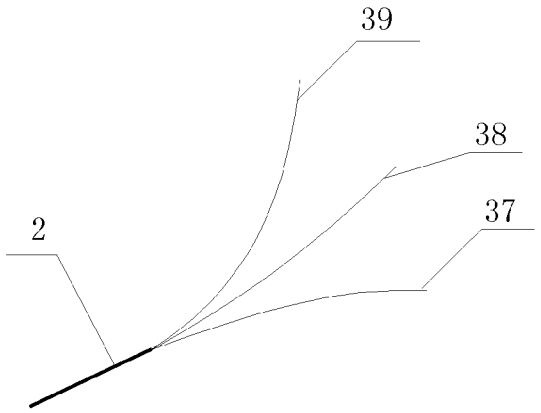
FIG. 3 shows in detail the structure of the composite membrane of the present invention.

Under normal operation temperature, membrane 2 is quite flexible with resistance to folding, corrosion of oil and impurities in the oil and oil temperature; the membrane is also non-inflammable, airtight and with anti-static quality. Such requirements of the membrane can be satisfied by modifying (e.g. use black lead or carbon black to increase electric conduction) such oil-proof materials as fluoroplastics, polyurethane, nitrile rubber, ethylene-vinyl alcohol copolymer, polyvinylidene chloride, nylon and silastic or by forming a composite membrane (e.g. Multi-layer Composite Co-extrusion Membrane) together with other materials (e.g. polyethylene). FIG. 3 shows the structure of composite membrane consisting of inner layer 37, middle layer 38 and outer layer 39. Inner layer 37 is resistant to corrosion of oil and impurities and is anti-static; middle layer 38 can block the air and outer layer 39 is resistant to wear, heat, water, ozone and ultraviolet rays. A composite membrane can be made of 3, 5, 7 or 9 layers of membranes or can be a single layer of membrane, for example modified fluorplastic membrane, which embodies all the said features. Membrane materials can be chosen based on the type of materials to be stored.

If the material to be stored is either chloride nor ethers material, it is recommend using modified fluorplastic membrane or waxing cloth made by for example fiberglass cloth impregnated by modified fluorine coating. When storing water-free oil product, ethylene-vinyl alcohol copolymer, polyurethane, nitrile rubber and modified nylon can be used as the inner layer, ethylene-vinyl alcohol copolymer, polyvinylidene chloride can be used as middle layer to block the air, and modified polyethene with carbon black can be used as the outer layer to resist wear, flaming, water, ozone and ultraviolet rays.

Outer wall 1 of tank car is made of metal or plastic materials with capability of resistance to static electricity (electric conduction).

Figure 4:
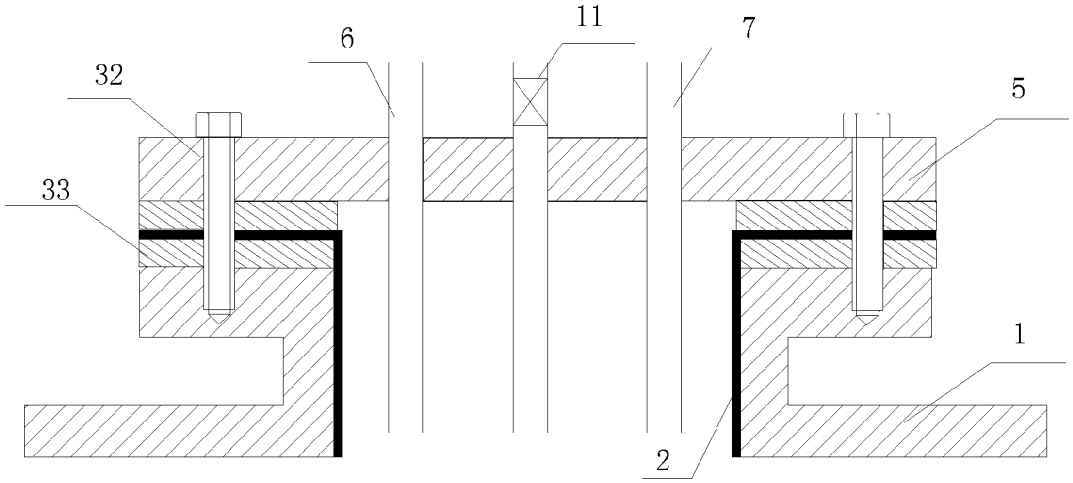
FIG. 4 shows the structure of fixing the membrane on the installation opening with bolts.
Figure 5:
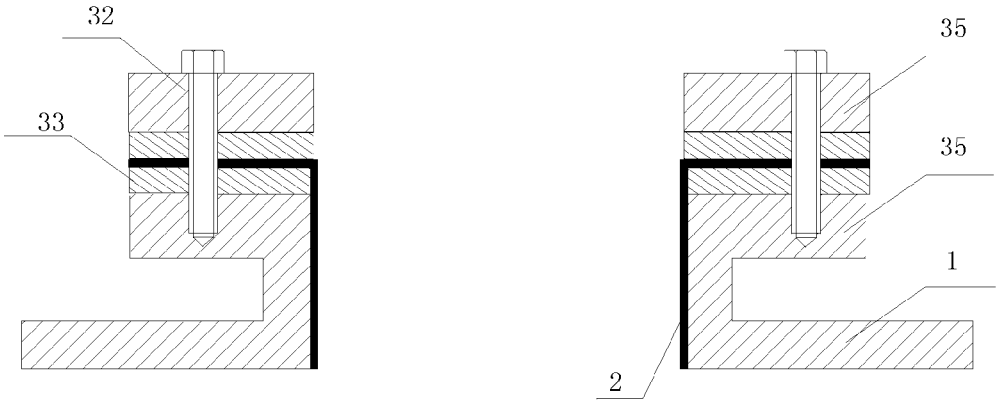
FIG. 5 shows the structure of fixing membrane on flanges of oil inlet and outlet with bolts.

Membrane 2 can be fixed in installation opening 3 and oil outlet 7 using bolts or adhesive or a combination thereof, as shown in FIGS. 4 and 5.

Figure 6:
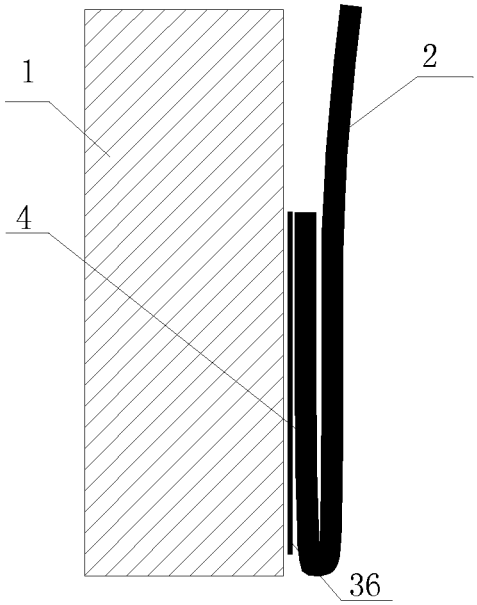
FIG. 6 shows the structure of fixing membrane with adhesive.

If an adhesive is used, membrane 2 should be fixed in installation opening 3 and outer wall 1 around oil outlet 7 using conductive adhesive 36 which is connected to the inner layer 37 of membrane 2 (anti-static layer) and the anti-static layer of outer wall 1 to eliminate static electricity, as shown in FIG. 6.

Figure 7:
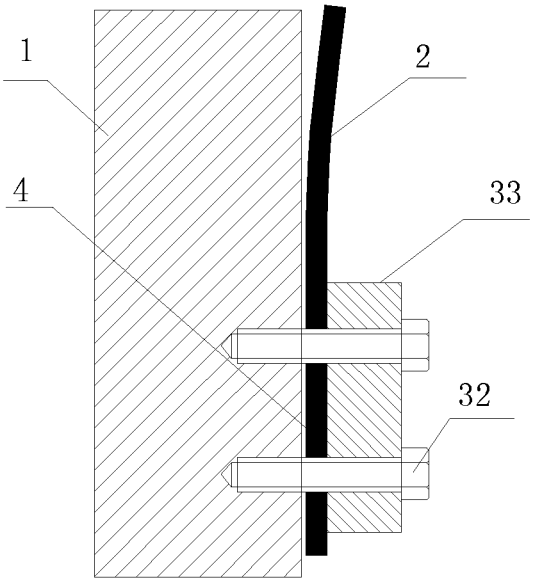
FIG. 7 shows the structure of fixing membrane with bolts.

If a bolt is used, the membrane should be fixed with bolt 32 and conductive gasket 33 so as to eliminate static electricity, as shown in FIG. 7.

Figure 8:
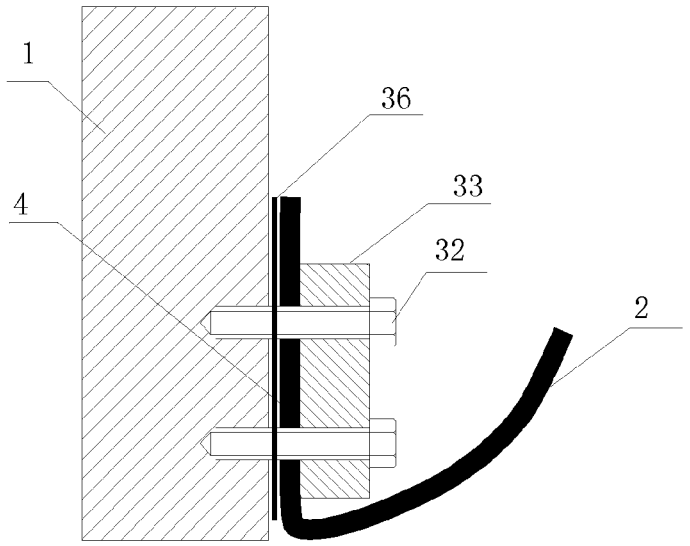
FIG. 8 shows the structure of fixing membrane using bolts and adhesive.

If a combination of adhesive and bolt is used, membrane should be fixed using bolt 32, conductive gasket 33 and conductive adhesive 36 concurrently, as shown in FIG. 8.

If installation opening 3 is fixed with a bolt, membrane 2 is fixed on the installation opening 3 using bolt 32 and conductive gasket 33; conductive gasket 33 can be of either single layer or double layer and is connected to the inner layer 37 (anti-static layer) of membrane 2 as well as the anti-static layer of outer wall 1 so as to eliminate the static energy, as shown in FIG. 4.

If flange 35 of oil outlet 7 is fixed using a bolt, membrane 2 is fixed in flange 35 of oil outlet 7 using 32 and conductive gasket 33; conductive 33 can be either single layer or double layer and is connected to the inner layer 37 (anti-static layer) of membrane 2 as well as the anti-static layer of outer wall as so to eliminate the static energy, as shown in FIG. 5.

The volume of chamber 12 formed by membrane 2 is not smaller than that of outer wall 1. The force membrane 2 receives is sufficiently transferred to outer wall 1, making membrane 2 receive a small force from the time it is empty till its volume reaches safety volume.

When oil, through quick coupling 22 of tank car and valve 15, flows from oil inlet 6 and flange 35 into membrane 2 and oil storage chamber 12, membrane gradually expands till it clings to insulation layer 16, thus transferring the force to outer wall 1. The air between membrane 2 and insulation layer 16 is discharged through breathing orifice 10.

When oil flows out of membrane 2 through flange 35, valve 15 and oil outlet 7, membrane 2 gradually shrinks and the air enters the space between insulation layer 16 and membrane 2 through breathing orifice 10.

To oil inlet 6 and oil outlet 7 are provided valve 15 and quick coupling 22 of tank so as to achieve closed oil unloading and receiving. During the whole process of storage, membrane 2 covers the oil surface to prevent volatilization of oil so as to achieve closed storage and transportation of oil.

When the temperature of oil exceeds the boiling point of fractions of oil product, the formed oil vapor can be stored inside membrane 2 under safety pressure. The combination of membrane and outer wall 1 can withstand saturated vapor pressure under the highest environment temperature to keep balance between vapor and liquid. When temperature declines, the saturated vapor condenses to liquid again.

In top installation opening 3, safety valve 11 is arranged to discharge the oil vapor produced by fractions with low boiling point when the pressure is excessively high. As the discharged oil vapor contains no air, its treatment is quite safe and convenient.

Insulation layer 16 is arranged to reduce the effects of sunshine and air temperature on tank temperature. The necessity of arrangement of insulation layer 16 is based on the differences of sunshine and temperature in the area as well as needs of oil product. When it is unnecessary to keep the temperature, the insulation layer 16 can be omitted.

The shallow soil temperature in China is normally under 20° C. If oil depot is built underground, measures taken to insulate heat can prevent oil temperature from reaching its boiling point.

If a variety of oils (e.g. different grades of gasoline and diesel oil) need to be transported at the same time, several installation openings 3 can be provided in one tank car to install several membranes 2 and oil outlets 6/7. The volume of each chamber can be adjusted as required.

A leakage detection sensor 14 can be arranged between insulation layer 16 (outer wall 1 if insulation layer 16 is not arranged) and membrane 2 to detect whether there is any oil leakage.

Liquid level sensor 34 can be arranged inside oil storage chamber to detect the liquid level, measure the volume of oil and prevent overflow of oil.

Access opening 13 is arranged on the top of tank. Besides maintenance, the access opening 13 allows personnel to operate inside the tank to unload any residual oil as well as observe loading process when receiving oil so as to avoid over-loading.

Embodiment II

Figure 10:
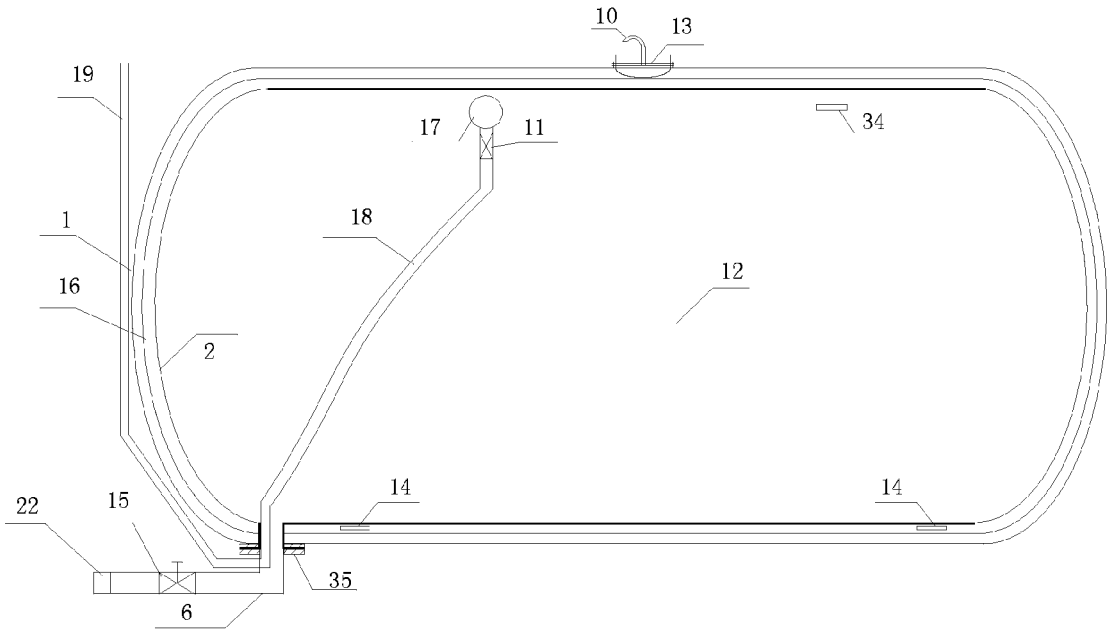
FIG. 10 shows the structure of Embodiment 2 (Tank Car 2)

Tank Car 2 (membrane fixed in the bottom): as shown in FIG. 10, comprising outer wall 1, oil inlet and outlet 6 (a combination of oil inlet 6 and oil outlet 7) in the bottom of car and breathing orifice 10. Membrane 2 is arranged inside outer wall 1, and insulation layer 16 is arranged between outer wall 1 and membrane 2, with insulation layer 16 clung to outer wall 1 and membrane 2 fixed in the flange 35 of oil inlet and outlet 6. The rest part of membrane 2 is separated from insulation layer 16. In oil inlet and outlet 6, valve 15 and quick coupling 22 of tank car are arranged.

In installation opening 3, a safe discharge system is arranged consisting of safety valve 11, floater 17, discharge hose 18 and discharge pipe 19. When the pressure is over high, the system discharges oil vapor produced by fractions of low boiling point, with floater 17 keeping safety valve 11 floating on the liquid surface when oil vapor is produced. Since the discharged oil vapor contains no air, its treatment is safe and convenient.

The fixing manner of membrane 2 in oil inlet and outlet 6 is the same as that of membrane 2 in oil outlet 7 in Embodiment I.

Other structures are arranged similar to or the same as those described in Embodiment I.

As for a newly-built tank car, access opening 13 can be arranged in oil inlet and outlet 6 and flange 35 of oil inlet and outlet 6 can be arranged on access opening 13. In this case, the whole membrane 2 can be taken out through access opening 13 for maintenance, while breathing orifice 10 still remains on the top, facilitating oil breathing.

Embodiment III

Figure 11:
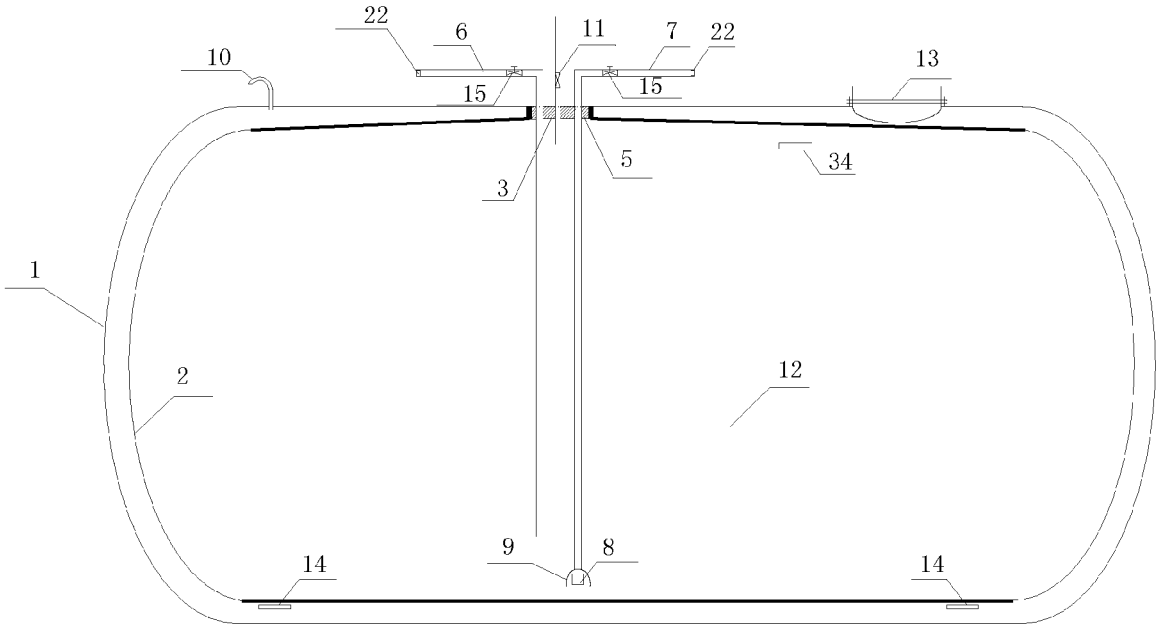
FIG. 11 shows the structure of Embodiment 3 (Horizontal Tank)

Horizontal Oil Tank: as shown in FIG. 11, comprising outer wall 1 of tank, installation opening 3, blocking cover 5, oil inlet 6, oil outlet 7, access opening 13, and breathing orifice 10. Oil inlet 6 and oil outlet 7 are both arranged on top of the tank. Membrane is arranged inside outer wall and fixed in installation opening 3, with the rest part of membrane 2 separated from outer wall 1. Valve 15 and quick coupling 22 of tank car are arranged on both oil inlet 6 and oil outlet 7.

In the lower part of oil outlet 7, oil-out pump 8 and oil-out pump cover 9 are arranged. Oil-out pump can also be arranged outside oil tank.

Outer wall 1 is made of metal or plastic materials with a capability of resistance to static electricity (electric conductivity).

If necessary, insulation layer 16 can be arranged in the same manner as in Embodiment I.

The fixing manner of membrane 2 in installation 3 is the same as those described in Embodiment 2.

Other structures are arranged similar to or the same as those described in Embodiment I.

Embodiment IV

Figure 12:
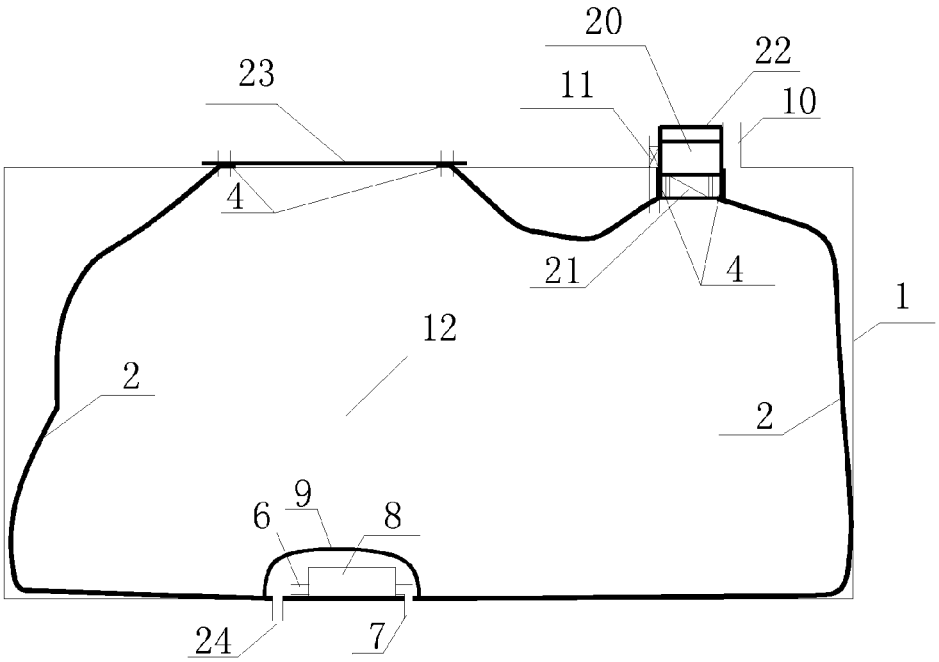
FIG. 12 shows the structure of Embodiment 4 (Device Oil Tank 1)

Apparatus Oil Tank 1 (oil-out pump arranged inside oil tank): as shown in FIG. 12, comprising outer wall 1 of oil tank, oil inlet and outlet 6, oil outlet 7, breathing orifice 10, oil filling pipe 20 and top access cover plate 23 (equivalent to installation opening 3 in function). Oil inlet 6 and oil outlet 7 are both arranged in bottom of oil tank. Membrane 2 is arranged inside outer wall 1 and fixed in the bottom of oil-out pump 8, the contacting areas of oil inlet 7, oil-out pump cover 9 and oil unloading port 24 with oil tank. The rest part of membrane 2 is separated from outer wall 1. One-way valve 21, safety valve 11 and quick coupling of oil tank 22 are arranged in oil filling pipe 20 of the tank, and oil-out pump 8, oil-out pump cover 9 and oil unloading port 24 are arranged in the bottom of oil tank.

Membrane 2 is fixed with bolt in the bottom of oil-out pump 8 and the membrane fixing section 4 of top access cover plate 23; the membrane fixing section 4 around oil filling pipe 20 on top of the tank, as shown in corresponding part of Embodiment I.

See Embodiment I for materials of membrane 2.

Figure 14:
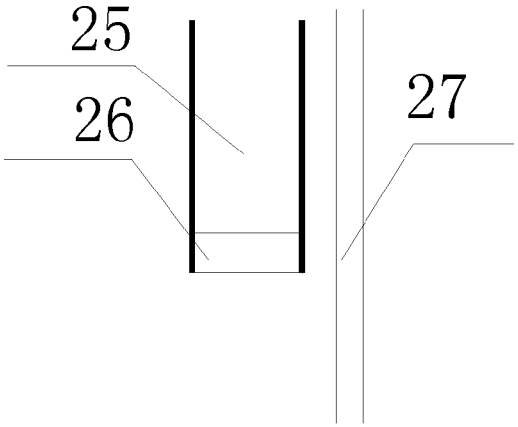
FIG. 14 shows the structure of Embodiment 5 (Device Oil Tank Equipped with Oil Gun)

Conventional oil gun needs adaption to facilitate oil filling of the tank. As shown in FIG. 14, conventional oil filler is engineered into quick coupling 26 and discharge pipe is engineered into air port switch 27.

During the process of filling apparatus oil tank with oil, the tank is connected with oil gun 35 through quick coupling 26 of oil gun and quick coupling 22 of oil tank, with air port 27 of oil gun reaching into outer wall 1 through breathing orifice 10. A predetermined amount of oil can be filled, and oil can be filled to safety volume of tank through automatic control. When the filled oil reaches safety volume, the membrane seals air port 27 of oil gun and stops filling.

When oil enters membrane 2 of oil tank from quick coupling 22 of oil tank through one-way valve, membrane 2 expands, which discharges the air between membrane 2 and outer wall 1 through breathing air 10; when oil flows out through oil outlet 7, membrane 2 gradually shrinks and air enters the space between membrane 2 and outer wall 1 through breathing orifice 10; membrane 2 covers the oil surface all the time to prevent volatilization.

Oil-out pump cover 9 is arranged to prevent membrane from blocking oil-out pump and oil inlet 6 and keeps oil-out pump soaked in oil to reduce its temperature. Oil-out pump cover 9 is of a grid form.

After oil is discharged through oil unloading port 24, top access cover plate 23 of oil tank can be opened so as to repair oil-out pump 8.

When pressure in oil tank is over high, safety valve 11 starts to work in order to decrease pressure.

When the apparatus (automobile) is crashed resulting crack on the oil tank, the membrane can prevent oil from spilling out to avoid causing fire and explosion of vehicle.

Embodiment V

Figure 13:
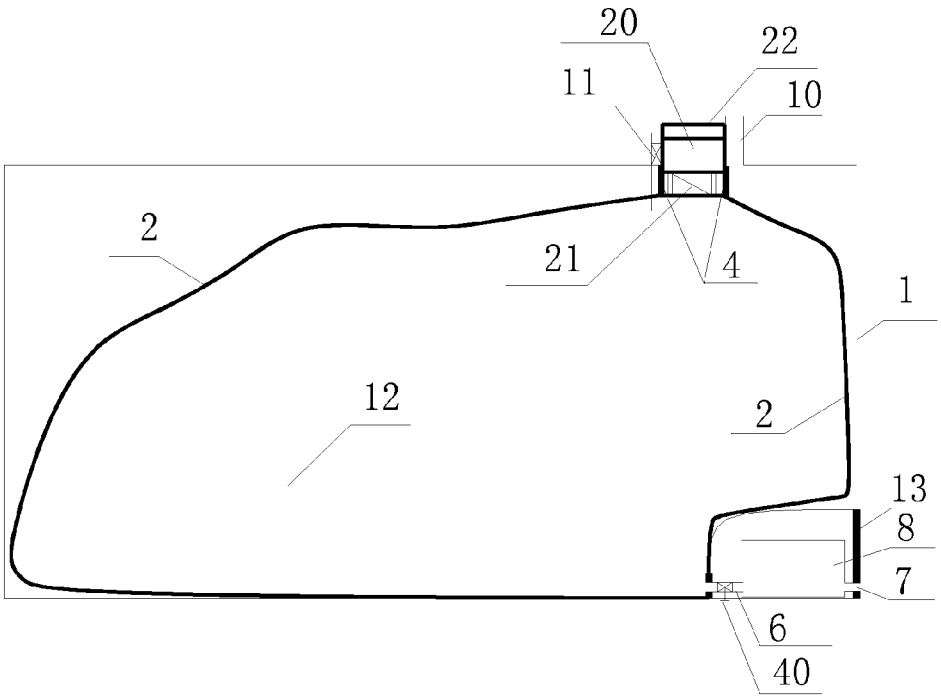
FIG. 13 shows the structure of Embodiment 5 (Device Oil Tank 2)

Apparatus Oil Tank 2 (oil-out pump outside the oil tank): as shown in FIG. 13, comprising outer wall 1 of oil tank, oil inlet 6, oil outlet 7, breathing orifice 10 and oil filling pipe 20 of oil tank. Oil inlet 6 and oil outlet 7 are in the bottom of oil tank. Arranged inside outer wall 1, membrane 2 is fixed in oil inlet 6 near the tank bottom as well as membrane fixing section 4 around the oil filling pipe 20 on top of the tank. The rest part of membrane 2 is separated from outer wall 1. One-way valve 21, safety valve 11 and quick coupling 22 of oil tank are also arranged in oil filling pipe 20 of oil tank. Access opening 13 and access valve 40 are also arranged in oil-out pump 8 which is in the exterior of oil tank.

After closing access valve 40, oil pump 8 can be repaired through access opening 13.

Membrane 2 is fixed with adhesive in oil inlet 6 and membrane fixing section 4 around oil filling pipe 20 of oil tank, as described in Embodiment I.

Other structures are arranged similar to or the same as those described in Embodiment I.

Embodiment VI

Figure 15:
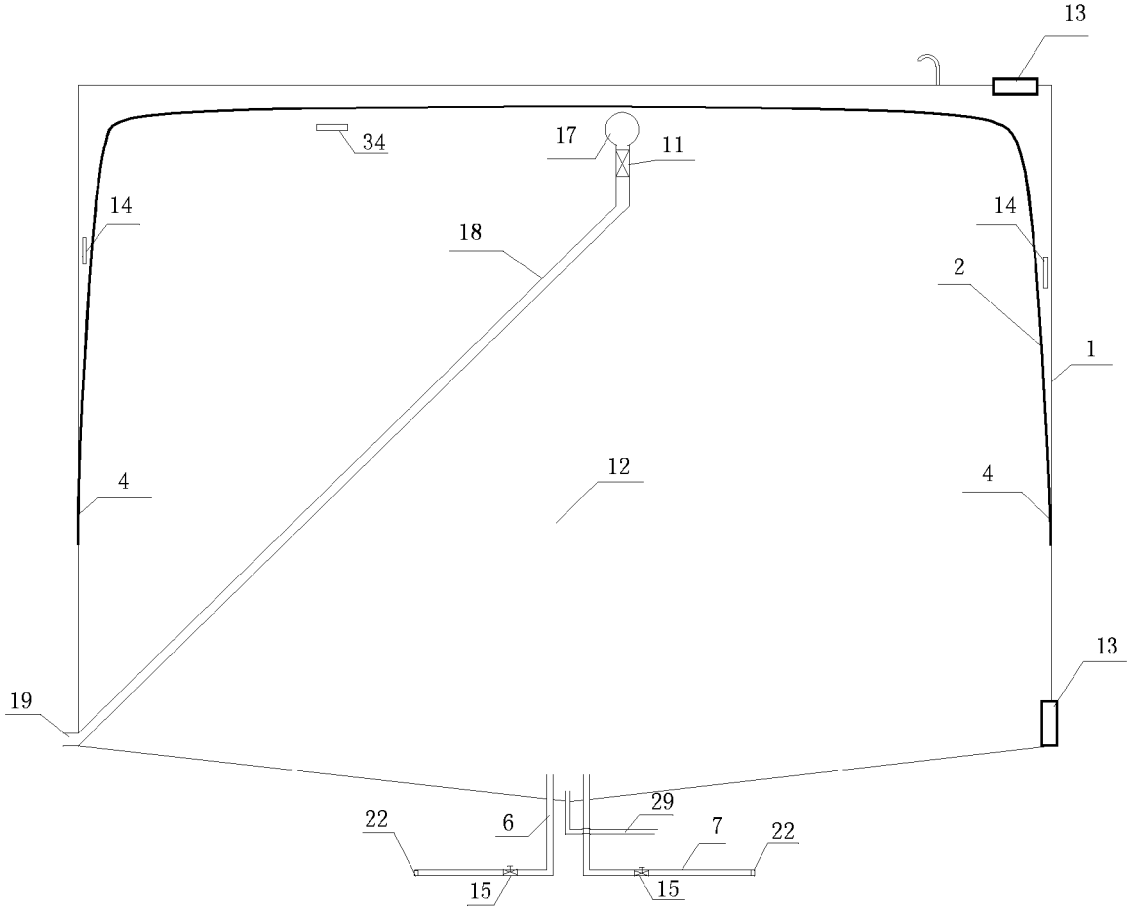
FIG. 15 shows the structure of Embodiment 6 (Membrane Coverage Replacing Inner Floating-roof Oil Tank)

Membrane cover replacing inner floating-roof storage tank: as shown in FIG. 15, comprising outer wall 1 of oil tank, oil inlet 6 and oil outlet 7. Arranged inside outer wall 1, membrane 2 covers the upper part of outer wall 1 of storage tank and is fixed at membrane fixing section 4 in the lower part of outer wall 1. The rest part of membrane 2 is separated from outer wall 1. Valve 15 and quick coupling 2 are arranged on both oil inlet 6 and oil outlet 7. Sewage drain pipe 29 is arranged in the bottom of storage tank and access opening 13 at the edge of tank bottom. Membrane 2 completely covers oil product surface and separates oil product from air with air outside the membrane breathing through breathing orifice 10.

Membrane is fixed with adhesive and bolt in membrane fixing section 4 on outer wall 1. See corresponding part in Embodiment I for details.

For details of membrane 2 materials and composite membrane structure, see Embodiment I.

Figure 1:
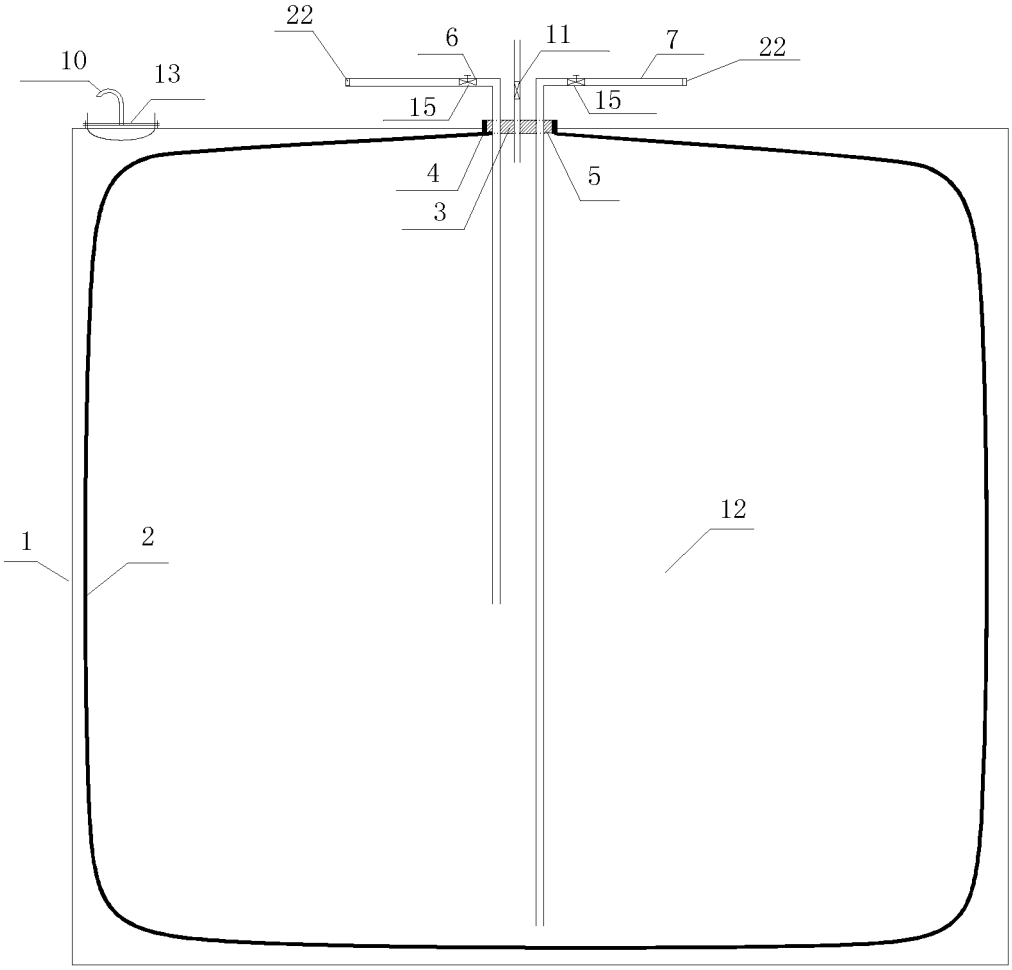
FIG. 1 shows the general structural view of the present invention.
Figure 2:
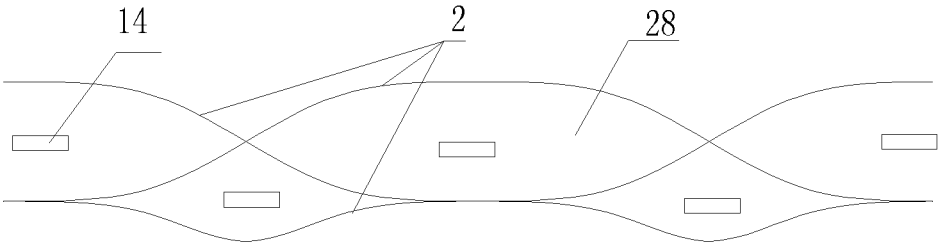
FIG. 2 shows the structure of composite membrane of the present invention.

When oil storage chamber 12 is large enough, a composite membrane of 3~5 layers of membranes can be used. The space between membranes are made into separate space 28, wherein leakage detection sensor 14 is arranged to improve reliability and detection positioning ability for repairing, as shown in FIG. 2. When oil product needs insulation to maintain its temperature, separate space 28 is filled with flexible foaming materials (e.g. polyurethane) and inert gas (e.g. nitrogen); when insulation is not needed, separate space 28 is vacuumed.

Inside the tank, a safe discharge system is arranged consisting of safety valve 11, floater 17, discharge hose 18, discharge pipe 19. When pressure is over high, said system discharges oil vapor and floater 17 enables safety valve 11 to stay floating on the liquid surface when oil vapor is produced. Since the discharged oil vapor contains no air, it is safe and convenient to burn it.

Valve 15 and quick coupling 22 are arranged in both oil inlet 6 and oil outlet 7, to achieve sealed oil unloading and receiving. During the process of oil storage, membrane 2 always covers the oil surface to prevent volatilization of oil. Thus sealed storage and transportation of oil is achieved.

Sewage drain pipe 29 is used to blow off sewage contained in oil product. It is unnecessary to arrange sewage drain pipe 29 if oil being stored does not contain sewage.

Embodiment VII

Figure 16:
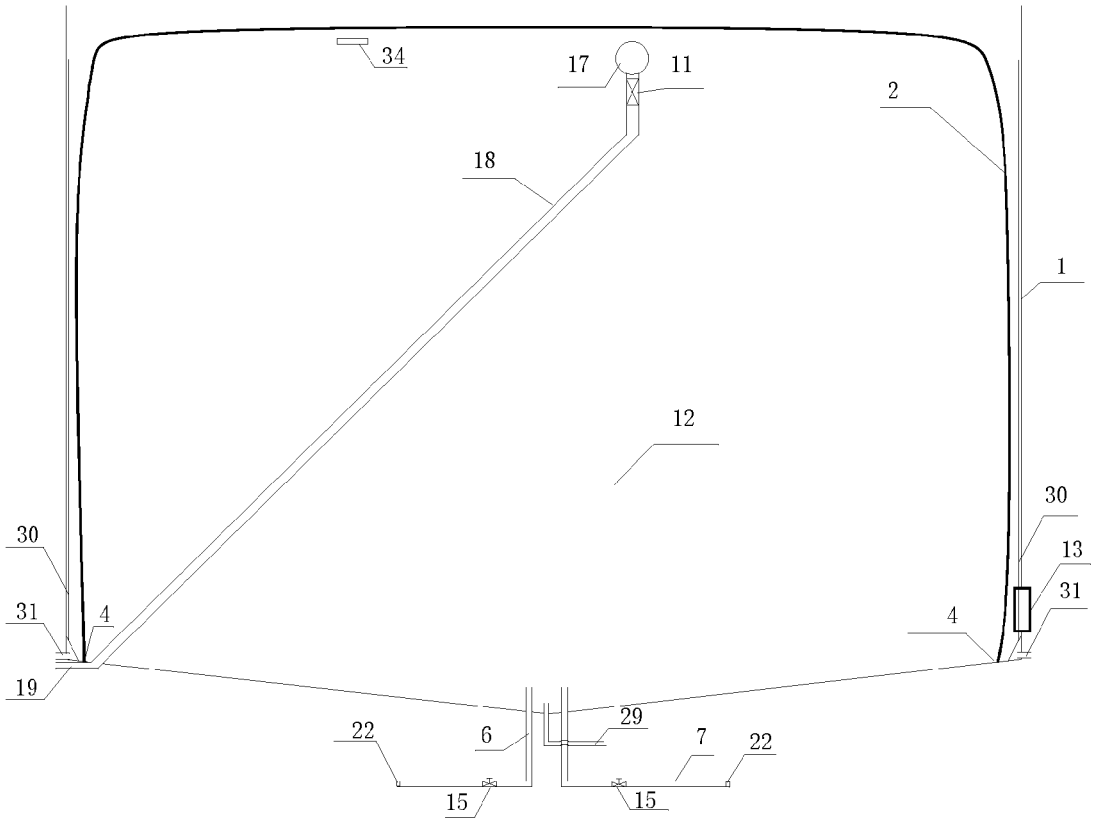
FIG. 16 shows the structure of Embodiment 6 (Membrane Coverage Replacing Outer Floating-roof Oil Tank).

Membrane coverage replacing outer floating-roof storage tank: as shown in FIG. 16, comprising existing outer wall 1 of storage tank, oil inlet 6 and oil outlet 7. Arranged inside outer wall 1, membrane 2 is fixed in vertical wall of outer wall 1 as well as membrane fixing section 4 in the bottom corner. The rest part of membrane is separated from outer wall 1. Valve 15 and quick coupling 22 are arranged on both oil inlet 6 and oil outlet 7. Sewage drain pipe 29 is arranged in the bottom of tank, and access opening 13 is arranged in peripheral edge of bottom tank. Membrane completely covers oil surface, and separates oil product from air with air outside the membrane taking part in breathing through the open storage tank top.

Rain collecting pipe 30 and outfall 31 are arranged in peripheral edge of tank bottom to drain the rain water outside membrane 2. Rain collecting pipe is a sieve pipe with drilled holes.

Other structures are arranged similar to or the same as those described in Embodiment I.

The oil storage apparatus of the present invention also applies to storage and transportation of products other than oil products in low and ordinary pressure, such as methanol, ethanol and other liquid chemicals suitable for storage under low and ordinary pressure. It is also suitable for water transportation.

The preferred embodiments of the present invention have been set forth in the above passages with drawings and examples. Obviously, the present invention is not limited to the said embodiments. Any modification within the scope of the present invention is not excluded from the protection scope of this invention.

The invention claimed is:

1. An oil storage and transportation apparatus comprising:

an outer wall (1), an installation opening (3), a sealing cover plate (5), an oil inlet (6) and an oil outlet (7), which are arranged on top or bottom of the apparatus and provided with a valve and a quick coupling;

an access opening (13) and a breathing orifice (10);

a membrane (2) arranged inside the outer wall (1) and fixed at the installation opening (3) or at the oil inlet (6) and the oil outlet (7), the membrane having a plurality of layers separated by a plurality of separate spaces filled with foaming materials and inert gas, a rest part of the membrane (2) being separated from the outer wall (1); and a plurality of leakage detection sensors, each of which is arranged in each of the plurality of separate spaces.

2. The oil storage and transportation apparatus according to claim 1, wherein said membrane (2) is a flexible composite membrane made of a material selected from a group consisting of fluoroplastics, polyurethane, ethylene-vinyl alcohol copolymer, polyvinylidene chloride, silastic, nylon and nitrile rubber; and an inner layer (37) of said composite membrane is an anti-static layer resistant to corrosion of oil and impurities, a middle layer (38) of said composite membrane blocks air, and an outer layer (39) of said composite membrane is resistant to wear, flame, water, oxidation and ultraviolet.

3. The oil storage and transportation apparatus according to claim 1, wherein said membrane (2) is fixed in the installation opening (3) through the sealing cover plate (5) and a first conductive gasket using a first bolt, conductive adhesive (36) or a combination thereof;

said membrane (2) is fixed in the oil inlet (6) and the oil outlet (7) through a flange (35) and a second gasket with a second bolt.

4. The oil storage and transportation apparatus according to claim 3, wherein said first conductive gasket and said conductive adhesive (36) are connected to the inner layer (37) of said membrane (2) and an anti-static layer of the outer wall (1).

5. The oil storage and transportation apparatus according to claim 1, wherein a part of the membrane (2) is fixed at a membrane fixing section (4) arranged on the outer wall (1) with a second bolt, a second gasket and a conductive adhesive (36).

6. The oil storage and transportation apparatus according to claim 1, when the oil inlet (6) and the oil outlet (7) are arranged on the top of the apparatus, a safety valve arranged in the installation opening (3).

7. The oil storage and transportation apparatus according to claim 1, when the oil inlet (6) and the oil outlet (7) are arranged on the bottom of the apparatus, a safety valve is arranged inside the membrane (2), and a floater (17) arranged in the safety valve and connected to a hose (18) and a discharge pipe (19).

8. The oil storage and transportation apparatus according to claim 1 further comprising an insulation layer (16) arranged between the outer wall (1) and the membrane (2).

9. The oil storage and transportation apparatus according to claim 8, wherein a leakage detection sensor (14) is arranged between the insulation layer (16) and the membrane (2).

10. The oil storage and transportation apparatus according to claim 1 further comprising a liquid level sensor (34) inside the membrane (2).

* * * * *